US005156892A

United States Patent [19]

Lapluye et al.

[11] Patent Number: 5,156,892

[45] Date of Patent: Oct. 20, 1992

[54] COMPOSITIONS FOR PROTECTING METALS, PROCESSES FOR THEIR PREPARATION, AND METHODS OF PROTECTING METALS

[76] Inventors: Gérard Lapluye, La Roseraie - 108/112, Avenue de Paris, 78000 Versailles; Fan B. Tao, 3, rue Curial - 75019, Paris, both of France

[21] Appl. No.: 554,691

[22] Filed: Jul. 6, 1990

[30] Foreign Application Priority Data

Jul. 12, 1989 [FR] France ..... 89 09378
May 4, 1990 [FR] France ..... 90 05670

[51] Int. Cl.[5] ..... B05D 3/02

[52] U.S. Cl. ..... 427/353; 427/388.4; 427/421; 427/435; 252/392; 252/390; 252/391; 422/7

[58] Field of Search ..... 427/384, 388.4, 353, 427/388.1, 430.1, 421, 435; 252/392, 390, 391; 422/7

[56] References Cited

U.S. PATENT DOCUMENTS 3,015,580 1/1962 Zisman et al. ..... 427/435
3,573,225 3/1971 Kondo ..... 252/392
3,625,859 12/1971 Hashimoto ..... 252/392
3,751,331 8/1973 Dane et al. ..... 427/388.4
4,051,066 9/1977 Miksic et al. ..... 252/392
4,233,176 11/1980 Conner, Sr. ..... 427/388.1
4,253,886 3/1981 Aonuma et al. ..... 427/127
4,705,703 11/1987 Meier et al. ..... 427/239
4,894,278 1/1990 Servais et al. ..... 427/427
4,957,640 9/1990 Treybig et al. ..... 252/392

FOREIGN PATENT DOCUMENTS 75013750 2/1970 Japan ..... 252/392
75013751 3/1970 Japan ..... 252/392
75013753 3/1970 Japan ..... 252/392
1073092 9/1987 Japan ..... 252/392

*Primary Examiner*—Michael Lusigman
*Assistant Examiner*—Diana L. Dudash
*Attorney, Agent, or Firm*—Fleit, Jacobson, Cohn, Price, Holman & Stern

[57] ABSTRACT

The present invention relates to compositions for protecting metals which contain a mixture constituted by stearic acid, dicyclohexylamine, and an azole derivative, and more particularly to a composition containing from 0.8 to 1.4 g/l of 1-phenyl-5-mercaptotetrazole, and from 0.005 to 0.01 g/l of the mixture stearic acid:dicyclohexylamine in the molar ratio 1:1, in solution in water, as well as to the process for its preparation, and to methods for protecting metals using said compositions.

9 Claims, No Drawings

COMPOSITIONS FOR PROTECTING METALS, PROCESSES FOR THEIR PREPARATION, AND METHODS OF PROTECTING METALS

The present invention relates to compositions for protecting metals as well as to a process for the manufacture of said compositions, and to a method for protecting metals.

Many metals undergo surface oxidation simply by exposure to air. This has the consequence not only of an alteration in the color and of the brilliance of said metals, but also an alteration of their properties, such as conductivity.

It is hence important to have available products enabling the protection of metal surfaces for the purpose of preserving their decorative appearance, and their functional properties.

Certain products have been designed for this purpose. These products, however, have the drawback of containing organic solvents, such as dichloroethane, which, besides their unpleasant smell, have a certain toxicity, which limits their use.

Certain of these products contain chromic acid. This compound, which is suitable for cleaning metal surfaces, has on the other hand, only a limited effectiveness for protecting the latter against oxidization.

The object of the present invention is hence to provide a novel protective composition for metals which is more effective than known compositions and non-toxic since it does not necessitate the use of an organic solvent.

According to the present invention, there are provided protective compositions for metals characterized in that they contain a mixture constituted by stearic acid, dicyclohexylamine, and an azole derivative endowed with anti-corrosive properties.

According to a preferred embodiment of the compositions for protecting metals according to the present invention, they contain a mixture comprising from 0.8 to 1.5 g/l of a suitable azole derivative, endowed with anti-corrosive properties, and 0.005 to 0.01 g/l of a stearic acid: dicyclohexylamine mixture in a molar ratio of 1:1, in solution in water.

According to a preferred arrangement of this embodiment, said composition contains a mixture constituted by 0.8 to 1.5 g/l of 1-phenyl-5-mercaptotetrazole, and 0.005 to 0.01 g/l of a stearic acid: dicyclohexylamine in a molar ratio 1:1, in solution in water.

According to another aspect of the present invention there is provided a process for preparing a composition for protecting metals, characterized in that a solution in water of a suitable azole derivative endowed with anti-corrosive properties, is prepared at a concentration of 0.8 to 1.5 g/l and that there is added to this solution 0.005 to 0.01 g/l of an equimolar mixture of stearic acid and dicyclohexylamine.

According to a preferred embodiment of this process, a solution of 1-phenyl-5-mercaptotetrazole in water is prepared, at a concentration of 0.8 to 1.5 g/l and there is added to this solution 0.005 to 0.01 g/l of an equimolar mixture of stearic acid and dicyclohexylamine.

According to another aspect of the present invention, there is provided a method for protecting a metal surface, characterized in that said metal surface is contacted with a protective composition according to the present invention, then rinsed with water.

According to a preferred embodiment of this method, the metal surface to be protected is immersed in the protective composition.

According to another embodiment of this method, the protective composition is sprayed on to the metal surface to be protected.

The present invention will be better understood by means of the additional description which follows, which refers to examples of the preparation of compositions and of the practising of methods of protecting metals which form the subject of the present invention.

It must be well understood, however, that these examples are given purely by way of illustration of the present invention of which they do not constitute a limitation in any way.

I

COMPOSITIONS FOR PROTECTING METALS ACCORDING TO THE PRESENT INVENTION

EXAMPLE I

A solution with 1 g/l of 1-phenyl-5-mercaptotetrazole is prepared.

A mixture of stearic acid: dicyclohexylamine in the molar ratio 1:1 is prepared. The mixture is brought to 70° C., then cooled to ambient temperature. 0.005 g of this mixture reduced to powder are dissolved by stirring, in a liter of 1-phenyl-5-mercaptotetrazole.

EXAMPLE 2

The process described in Example 1 is followed, using a solution with 1.5 g/l of 1-phenyl-5-mercaptotetrazole to which is added 0.008 g/l of the stearic acid: dicyclohexylamine.

EXAMPLE 3

The process described in Example 1 is followed, using a solution with 0.8 g/l of 1-phenyl-5-mercaptotetrazole, to which is added 0.006 g/l of the stearic acid: dicyclohexylamine mixture.

EXAMPLE 4

The process described in Example 1 is followed, using a solution with 1.2 g/l of 1-phenyl-5-mercaptotetrazole, to which is added 0.01 g/l of the mixture of stearic acid: dicyclohexylamine.

II

TREATMENT OF METALS FOR THEIR PROTECTION

EXAMPLE 5

The metal surface is scoured, if necessary, by a treatment with chromic acid, followed by a treatment with concentrated $NH_3$, then rinsed with tap water and with distilled water. The surface to be treated is immersed in the protective composition prepared according to one of the examples 1 to 4, kept at a temperature of 30° to 40° C., for a period of 3 to 5 min., then rinsed twice with distilled water. The first rinsing is performed at ambient temperature, the second rinsing at a temperature of 50° to 60° C. The metal surface is then dried at a temperature of about 60° to 70° C.

EXAMPLE 6

After scouring the metal surface to be treated, a protective composition prepared according to one of the examples 1 to 4 is sprayed on to the surface to be protected and left in contact with the latter for 3 to 5 min.

The surface thus treated is rinsed and dried as described in the preceding example.

A liter of protective solution enables the treatment, by one or other of the methods given as examples, of a metal surface of 40 to 70 $dm^2$.

III

CHECKING THE EFFECTIVENESS OF THE PROTECTIVE COMPOSITIONS ACCORDING TO THE INVENTION

EXAMPLE 7

Metal objects treated as described in examples 5 and 6 were exposed to an atmosphere containing 1% of $H_2S$, until the appearance of a color change.

Under these conditions, an untreated silver article changed in color after 2 min., whilst the treated article preserved its color for 60 min.

An untreated copper plate changes color entirely after one minute, whilst a treated copper plate starts to change in color after 132 minutes.

An article of 18 carat gold changes color after 60 min., without treatment, and 230 min. after treatment.

We claim:

1. Composition for protecting metals, comprising a mixture of stearic acid, dicyclohexylamine, and an azole derivative possessing anti-corrosive properties, in solution in water.

2. Composition for protecting metals, according to claim 1, characterized in that it contains a mixture constituted by 0.8 to 1.5 g/l of an azole derivative endowed with anti-corrosive properties, and from 0.005 to 0.01 g/l of a stearic acid: dicyclohexylamine mixture in the molar ratio 1:1 in solution in water.

3. Composition for protecting metals, comprising 0.8 to 1.5 g/l of 1-phenyl-5-mercaptotetrazole and 0.005 to 0.01 g/l of a stearic acid: dicyclohexylamine mixture in the molar ratio 1:1, in solution in water.

4. Process for the preparation of a composition for protecting metals, characterised in that there is prepared a solution of a suitable azole derivative, endowed with anti-corrosive properties, in water, at a concentration of 0.8 to 1.5 g/l and wherein there is added to this solution 0.005 to 0.01 g/l of an equimolar mixture of stearic acid and dicyclohexylamine.

5. Process for the preparation of a composition for protecting metals comprising preparing a solution of 1-phenyl-5-mecaptotetrazole in water, at a concentration of 0.8 to 1.5 g/l and adding to this solution 0.005 to 0.01 g/l of an equimolar mixture of stearic acid and dicyclohexylamine.

6. Method for protecting a metal surface, characterized in that said metal surface is contacted with a protective composition according to any one of claims 1 to 3, and then rinsed with water.

7. Method according to claim 6, characterized in that the metal surface to be protected is immersed in the protective composition.

8. Method according to claim 6, characterized in that the protective composition is sprayed on to the metal surface to be protected.

9. Composition for protecting metals comprising an azole derivative possessing anti-corrosive properties and an equimolar mixture of steric acid and dicyclohexylamine, in water solution.

* * * * *